US009474684B2

(12) United States Patent
Juto et al.

(10) Patent No.: US 9,474,684 B2
(45) Date of Patent: Oct. 25, 2016

(54) ELECTROACTIVE VIBRATION METHOD

(71) Applicant: CHORDATE MEDICAL AB, Kista (SE)

(72) Inventors: Jan-Erik Juto, Stockholm (SE); Fredrik Juto, Stockholm (SE); William Holm, Stockholm (SE)

(73) Assignee: CHORDATE MEDICAL AB, Kista (SE)

( * ) Notice: Subject to any disclaimer, the term of this patent is extended or adjusted under 35 U.S.C. 154(b) by 658 days.

(21) Appl. No.: 13/796,433

(22) Filed: Mar. 12, 2013

(65) Prior Publication Data

US 2013/0253389 A1 Sep. 26, 2013

Related U.S. Application Data

(60) Provisional application No. 61/613,376, filed on Mar. 20, 2012.

(30) Foreign Application Priority Data

Mar. 20, 2012 (EP) ..... 12160395

(51) Int. Cl.

| | |
|---|---|
| ***A61H 23/04*** | (2006.01) |
| ***A61H 21/00*** | (2006.01) |
| ***A61H 23/02*** | (2006.01) |

(52) U.S. Cl.

CPC ..... *A61H 23/04* (2013.01); *A61H 21/00* (2013.01); *A61H 23/02* (2013.01); *A61H 2201/0103* (2013.01); *A61H 2205/023* (2013.01)

(58) Field of Classification Search

CPC ..... A61H 23/02; A61H 23/04; A61H 21/00; A61H 2201/5074; A61H 2201/5071

See application file for complete search history.

(56) References Cited

U.S. PATENT DOCUMENTS

| | | | |
|---|---|---|---|
| 901,376 | A | 10/1908 | Roberts |
| 912,205 | A | 2/1909 | Talcott |
| 961,034 | A | 6/1910 | Siebert et al. |
| 1,735,519 | A | 11/1929 | Vance |
| 1,764,838 | A | 6/1930 | Horne |
| 2,052,321 | A | 8/1936 | Smart |

(Continued)

FOREIGN PATENT DOCUMENTS

| | | | |
|---|---|---|---|
| EP | 0935980 | A1 | 8/1999 |
| EP | 2418231 | A1 | 2/2012 |

(Continued)

OTHER PUBLICATIONS

Alstadhaug, "Migraine and the Hypothalamus", Cephalalgia, 2009, pp. 1-9.

Ansarinia et al., "Electrical Stimulation of Sphenopalatine Ganglion for Acute Treatment of Cluster Headaches", Headache, vol. 5, Jul. 2010, pp. 1164-1174.

(Continued)

*Primary Examiner* — Justine Yu
*Assistant Examiner* — Kathrynn Lyddane
(74) *Attorney, Agent, or Firm* — Birch, Stewart, Kolasch & Birch, LLP

(57) ABSTRACT

A method for treatment by vibration stimulation of body tissue in a body cavity of a human subject includes providing a stimulation member comprising a dielectric polymer; introducing the stimulation member into a body cavity; expanding the stimulation member to a state such that it abuts the body tissue within the body cavity, and applying a time varying potential to said dielectric polymer to impart vibrations to body tissue in the body cavity.

8 Claims, 7 Drawing Sheets

(56) References Cited

U.S. PATENT DOCUMENTS

| | | | | |
|---|---|---|---|---|
| 2,101,273 | A | 12/1937 | Smith | |
| 3,612,211 | A | 10/1971 | Clark, III | |
| 3,848,607 | A | 11/1974 | St. Clair | |
| 4,462,411 | A | 7/1984 | Rickards | |
| 4,911,149 | A | 3/1990 | Borodulin et al. | |
| 5,139,510 | A | 8/1992 | Goldsmith, III et al. | |
| 5,609,606 | A | 3/1997 | O'Boyle | |
| 5,682,881 | A | 11/1997 | Winthrop et al. | |
| 5,903,516 | A | 5/1999 | Greenleaf et al. | |
| 6,159,170 | A | 12/2000 | Borodulin et al. | |
| 6,193,680 | B1 | 2/2001 | Parsons et al. | |
| 6,358,272 | B1 | 3/2002 | Wilden | |
| 6,461,314 | B1 * | 10/2002 | Pant | A61B 17/2202 600/439 |
| 6,514,237 | B1 | 2/2003 | Maseda | |
| 8,317,816 | B2 | 11/2012 | Becker | |
| 2001/0049466 | A1 | 12/2001 | Leysieffer et al. | |
| 2001/0051819 | A1 | 12/2001 | Fischell et al. | |
| 2002/0072781 | A1 | 6/2002 | Lattner et al. | |
| 2002/0177889 | A1 | 11/2002 | Brisken et al. | |
| 2003/0087734 | A1 | 5/2003 | Kring et al. | |
| 2004/0097850 | A1 | 5/2004 | Plante | |
| 2004/0172112 | A1 | 9/2004 | Cioanta et al. | |
| 2004/0230252 | A1 | 11/2004 | Kullok et al. | |
| 2004/0243172 | A1 | 12/2004 | Hogle | |
| 2005/0011518 | A1 | 1/2005 | Biondo et al. | |
| 2005/0021092 | A1 | 1/2005 | Yun et al. | |
| 2005/0054958 | A1 | 3/2005 | Hoffmann | |
| 2005/0165439 | A1 | 7/2005 | Weber et al. | |
| 2006/0094992 | A1 | 5/2006 | Imboden et al. | |
| 2006/0190022 | A1 | 8/2006 | Beyar et al. | |
| 2007/0123809 | A1 * | 5/2007 | Weiss | A61H 21/00 601/84 |
| 2007/0149905 | A1 | 6/2007 | Hanna | |
| 2008/0198330 | A1 | 8/2008 | Taylor | |
| 2008/0200848 | A1 | 8/2008 | Avni | |
| 2008/0208168 | A1 | 8/2008 | Garabet | |
| 2008/0281238 | A1 | 11/2008 | Oohashi et al. | |
| 2009/0005713 | A1 | 1/2009 | Podrazhansky et al. | |
| 2009/0101448 | A1 | 4/2009 | Korkeakangas et al. | |
| 2009/0187098 | A1 | 7/2009 | Makower et al. | |
| 2009/0259315 | A1 | 10/2009 | Banik | |
| 2010/0004709 | A1 | 1/2010 | Mische | |
| 2010/0094209 | A1 | 4/2010 | Drasler et al. | |
| 2010/0211186 | A1 * | 8/2010 | Senders | A61F 9/00718 623/24 |
| 2010/0228075 | A1 | 9/2010 | Lu | |
| 2010/0234840 | A1 | 9/2010 | Jackson et al. | |
| 2010/0249637 | A1 | 9/2010 | Walter et al. | |
| 2010/0268121 | A1 * | 10/2010 | Kilborn | A61B 5/412 600/587 |
| 2010/0274164 | A1 * | 10/2010 | Juto | A61H 9/0078 601/46 |
| 2010/0286576 | A1 | 11/2010 | Pryor et al. | |
| 2010/0312322 | A1 | 12/2010 | Eidenschink et al. | |
| 2011/0190668 | A1 | 8/2011 | Mishelevich | |
| 2011/0270138 | A1 | 11/2011 | Mishelevich | |
| 2013/0102937 | A1 * | 4/2013 | Ehrenreich | A61H 1/00 601/47 |
| 2013/0261701 | A1 * | 10/2013 | Kuratle | A61N 1/0541 607/57 |

FOREIGN PATENT DOCUMENTS

| | | | |
|---|---|---|---|
| GB | 385992 | A | 1/1933 |
| GB | 1217760 | A | 12/1970 |
| JP | 2001-17500 | A | 1/2001 |
| JP | 2001-37883 | A | 2/2001 |
| KR | 10-1019957 | B1 | 3/2011 |
| RU | 2099039 | C1 | 12/1997 |
| RU | 2199303 | C1 | 2/2003 |
| SU | 1148614 | A | 4/1985 |
| SU | 1560205 | A1 | 4/1990 |
| WO | WO 86/01399 | A1 | 3/1986 |
| WO | WO 96/36396 | A2 | 11/1996 |
| WO | WO 96/39218 | A1 | 12/1996 |
| WO | WO 01/41695 | A2 | 6/2001 |
| WO | WO 2004/047675 | A2 | 6/2004 |
| WO | WO 2004/105579 | A2 | 12/2004 |
| WO | WO 2006/114783 | A2 | 11/2006 |
| WO | WO 2008/138997 | A1 | 11/2008 |
| WO | WO 2009/020648 | A1 | 2/2009 |
| WO | WO 2010/033055 | A1 | 3/2010 |
| WO | WO 2011/005165 | A1 | 1/2011 |
| WO | WO 2012/055436 | A1 | 5/2012 |

OTHER PUBLICATIONS

Bar-Shir et al., "Late Stimulation of the Sphenopalatine-Ganglion in Ischemic Rats: Improvement in N-Acetyl-Aspartate Levels and Diffusion Weighted Imaging Characteristics as Seen by MR", Journal of Magnetic Resonance Imaging, vol. 31, 2010, pp. 1355-1363.

Brown et al., "Towards a Physiology-Based Measure of Pain: Patterns of Human Brain Activity Distinguish Painful from Non-Painful Thermal Stimulation", Plos One, vol. 6, Iss. 9, e24124, Sep. 2011, pp. 1-8.

Carpi et al., "Folded dielectric elastomer actuators," Smart Materials and Structures, vol. 16, 2007, pp. S300-S305.

Carpi et al., "Millimetre-scale bubble-like dielectric elastomer actuators," Polymer International, vol. 59, 2010 (published online Dec. 18, 2009), pp. 407-414.

Jung et al., "A self-sensing dielectric elastomer actuator," Sensors and Actuators A, vol. 143, 2008, pp. 343-351.

Kim et al., "Predicting the Timing of Spikes Evoked by Tactile Stimulation of the Hand", J Neurophysiol, vol. 104, 2010, pp. 1484-1496.

Krajnak et al., "Characterization of Frequency-Dependent Responses of the Vascular System to Repetitive Vibration", JOEM, vol. 52, No. 6, Jun. 2010, pp. 584-594.

Kuncel et al., "Selection of Stimulus Parameters for Deep Brain Stimulation", Clinical Neurophysiology, vol. 115, 2004, pp. 2431-2441.

Leroux et al., "Cluster Headache", Orphanet Journal of Rare Diseases, vol. 3, No. 20, 2008, pp. 1-11.

Ludwig, "The Velocity of Sound through Tissues and the Acoustic Impedance of Tissues", The Journal of the Acoustical Society of America, vol. 22, No. 6, Nov. 1950, pp. 862-866.

Malm, "Measurement of Nasal Patency", Allergy, vol. 52 (suppl. 40), 1997, pp. 19-23.

Malm, "Stimulation of Sympathetic Nerve Fibres to the Nose in Cats", Acta Otolaryng, vol. 75, 1973, pp. 519-526.

Papon et al., "Nasal wall compliance in vasomotor rhinitis," J. Appl. Physiol., vol. 100, 2006 (First published Sep. 1, 2005), pp. 107-111, XP055055268.

Pelrine et al., "Electrostriction of polymer dielectrics with compliant electrodes as a means of actuation," Sensors and Actuators A, vol. 64, 1998, pp. 77-85.

Salansky et al., "Responses of the Nervous System to Low Frequency Stimulation and EEG Rhythms: Clinical Implications", Neuroscience and Biobehavioral Reviews, vol. 22, No. 3, 1998, pp. 395-409.

Tepper et al., "Acute Treatment of Intractable Migraine With Sphenopalatine Ganglion Electrical Stimulation", Headache, vol. 49, Jul. 2009, pp. 983-989.

VBM, "VBM Tube Fixations", VBM Medizintechnik GmbH, 2006, 6 pages provided.

Zelena, "Nerves and Mechanoreceptors: The Role of Innervations in the Development and Maintenance of Mammalian Mechanoreceptors", Springer, 1994, pp. 147-148.

Zhang et al., "Dielectric Elastomers in Actuator Technology," Advanced Engineering Materials, vol. 7, No. 5, 2005, pp. 361-367.

Klinger et al., "Untersuchungen zur Mikro-zirkulation der Nasenschleimhaut bei Verwendung von Ballon-tamponaden", Laryngo-Rhino-Otol., vol. 76, 1997, pp. 127-130, XP008066107.

* cited by examiner

ELECTROACTIVE VIBRATION METHOD

CROSS-REFERENCE TO RELATED APPLICATIONS

This application claims priority under 35 U.S.C. §119(e) to U.S. Provisional Application No. 61/613,376, filed Mar. 20, 2012. This application also claims priority under 35 U.S.C. §119(a) to Application No. 12160395.5, filed in Europe on Mar. 20, 2012. The entire contents of each of the above-identified applications are expressly incorporated herein by reference.

BACKGROUND OF THE INVENTION

1. Technical Field

The present invention relates to devices for vibration stimulation of body tissue in body cavities by means of an electroactive stimulation member. The present invention further relates to methods for vibration stimulation by means of electroactive stimulation members.

2. Description of Background Art

Various medical devices are known that employ ionic electroactive polymers (EAPs) in various medical applications. Balloon catheters comprising electro active parts consisting of ionic electroactive polymers are disclosed in e.g. US 2005/0165439 and US 2010/0312322. The balloon catheters, guidewires, stents, and aneurysm coils described therein may be used for implantation or insertion in body lumens for e.g. compressing atherosclerotic plaque and for delivery of prosthetic devices. Upon application of a small voltage, typically 1 or 2 volts, the ionic EAPs undergo deformation. The ionic EAPs typically have response times of the order of a few seconds.

Dielectric elastomers constitute another class of electroactive polymers generally having faster response times compared to the abovementioned ionic EAPs. Carpi et al (*Polym Int* 2010; 59:407-414) presented a specific type of a hydrostatically coupled (HC) dielectric elastomer (DE) actuator referred to as a push-pull HCDE actuator having a working frequency of around100 Hz. Such hydrostatically coupled DE actuators rely on an incompressible fluid that mechanically couples a DE-based active part to a passive part interfaced to the load. Carpi et al suggest development of such actuators for use as tactile displays and cutaneous stimulators.

Stimulation in body cavities by means of mechanical vibrations is disclosed in e.g. WO 2008/138997. This PCT publication discloses a device for vibration stimulation in a body cavity, such as the nasal cavity or the intestine, of a patient. The device comprises a stimulation member and an externally arranged vibration generator for bringing the stimulation member to vibrate. Vibration stimulation in the nasal cavity may be used for treatment of e.g. rhinitis.

In order to customize vibration treatment, improved methods and devices are however called for.

SUMMARY OF THE INVENTION

The object of the present invention is to provide improved methods and devices for vibration stimulation of body tissue.

There is, in a first aspect of the invention, provided a stimulation member for imparting vibrations to body tissue in a body cavity, comprising a flexible electrically insulating layer having a first surface and a second surface, wherein at least a part of the first surface of the layer is adapted to abut against the tissue of the body cavity; a first compliant electrically conducting layer provided on at least a part of the second surface of the insulating layer, and being electrically connectable to a first electrical potential; a dielectric polymer layer provided on at least a part of the first conducting layer; a second compliant electrically conducting layer provided on at least a part of the dielectric polymer layer, and being electrically connectable to a second electrical potential. The stimulation member may further be expandable. In such cases, the stimulation member can be arranged in a first state wherein the stimulation member can be introduced via a body opening into a body cavity, and a second state wherein the stimulation member is expanded to a volume such that the first surface of the electrically insulating layer abuts against the tissue within the body cavity.

Once contact is established between the body tissue and at least parts of the outermost surface of the stimulation member, i.e. the first surface of the insulating member, vibrations may be imparted to the body tissue by connecting the first and second electrically conducting layers to a first and second electrical potential. In principal, when an electrical potential is applied between the conducting layers, an electrostatic field occurs and the electrostatic force from the charges on the conducting layers mechanically loads the polymer layer. Due to this mechanical compression, the polymer layer, at least partly sandwiched between the first and second electrically conducting layers, may contract in the thickness direction. This might be understood as a decrease in the thickness of the polymer layer being at least partly sandwiched between the first and second electrically conducting layers. As a result, the area of the polymer layer may expand in a direction perpendicular to the thickness direction such that the polymer layer is enlarged in the plane. This area expansion of the polymer layer may thus force parts of the polymer layer, and thus parts of the stimulation member, to buckle out of the plane. Evidently, the parts of the stimulation member buckling out of the plane correspond to the part(s) where an electrical potential(s) has been applied across the electrically conducting layers. By varying the potential(s) applied to the electrically conducting layers, the degree of deformation of the polymer layer may repeatedly vary such as to impart vibrations to body tissue.

The stimulation member according to the first aspect thus has a (multi) layered structure. It may comprise one or more active regions, wherein each active region individually comprises at least an outermost electrically insulating layer, a first electrically conducting layer, a dielectric polymer layer, and a second electrically conducting layer. Such active regions may for example form patch-like structures on the second surface of the insulating layer and provides for selective vibration stimulation to body tissue. In order to maintain an overall flexibility of the stimulation member, the number of layers comprised in the stimulation member may be limited to the above defined four layers.

The stimulation member according to the first aspect thus eliminates the need for an externally arranged vibration generator. Furthermore, the stimulation member may comprise one or more active regions, comprising dielectric polymer sandwiched between the two conducting layers, and may thus allow local vibration stimulation of specific body tissue. In other words, vibration stimulation may, depending on the size of the active regions, be selectively delivered to body tissue at specific locations in the body cavity. The stimulation member may for example be in contact with a large tissue area while only parts of the stimulation member is brought to vibrate and consequently only part of the large tissue area is stimulated with vibrations.

Flexibility and compliance of individual layers render possible introduction of the stimulation member into the body cavity of a subject and swift response, i.e. deformation, to applied voltage while in the body cavity. Apart from being flexible, the insulating layer is electrically neutral and thus provides the stimulating member with an outer surface which may safely be inserted into and arranged to abut against the tissue in a body cavity of a subject.

As a further precautionary measure, the first electrically conducting layer may be connectable to a ground potential. Connection of the first conducting layer to a ground potential provides further safety in the case of rupture of the outermost insulating layer within the body cavity of a subject.

The second electrically conducting layer may on the other hand be connectable to at least one time varying potential. By frequent variation of the potential applied between the conducting layers, a corresponding frequency of deformation of the polymer layer and thus the stimulation member is accomplished. Vibrations are accordingly created and imparted to the tissue. It should be understood that when the stimulation member comprises several active regions, each of the regions may be separately connectable to first and second electric potentials.

As yet another safety measure, the first conducting layer may be provided on a part of the second surface of the insulating layer superposing the part of the first surface adapted to abut the tissue. In other words, the stimulation member in contact with the body tissue in the body cavity comprises at least a double layer, consisting of the insulating layer and the first conducting layer. Full coverage of the first conducting layer on the second surface by a continuous insulating layer further protects the subject in case of e.g. an electrical breakdown of the dielectric polymer layer.

However, stimulation members comprising further functional or insulating layers, e.g. for manufacturing or safety reasons, are also contemplated.

The dielectric polymer layer may for example comprise a dielectric polymer selected from the group consisting of polyurethane, silicone, fluorosilicone, ethylene propylene, polybutadiene, and isoprene. The material of the dielectric layer should be such as to allow manufacture of a multilayer structure and overall flexibility of the stimulation member. In particular, the multilayered structure of the stimulation member may be elastic.

The first and second electrically conducting layers may for example comprise a material selected from the group consisting of carbon grease, graphite powders, graphite spray, thickened electrolyte, sputtered gold, silver paste, and conductive polymers. It should be understood that in order to provide minimum resistance to deformation, the layers comprised in the stimulation member should be compliant.

In some embodiments of the stimulation member, the insulating layer and the first conducting layer define an enclosed volume comprising a fluid, wherein the second conducting layer superposes the enclosed volume. Thus, a fluid, such as silicone oil or corn oil, is provided within a defined region in-between the insulating layer and the first conducting layer. When a potential is applied to the superposing part of the second electrically conducting layer, the area of the corresponding part of the dielectric polymer layer is enlarged. This in turn influences the pressure in the fluid filled volume such that the pressure decreases. The fluid thus internally transmits the actuation from the dielectric layer, via the first conducting layer, to the insulating layer.

The fluid-filled volume provides yet another level of safety by further distancing the second electrically conducting layer from the body tissue of the subject. Moreover, the fluid filled volume may have a size of only a few millimeters, e.g. 6 mm, and may thus further improve the possibility of selectively delivering vibration stimulation to body tissue. In order to prevent in plane motion of and to force the stimulation member to deform in a direction perpendicular to the layers, a stiffener may be applied along a periphery of at least a part of the second conducting layer. One or more stiffeners provided around e.g. one or more layered patches, layered patterns, and electrodes hence facilitates deformation in a direction towards the contacting body tissue. A stiffener may for example consist of a polymer having sufficient stiffness.

As previously mentioned, the second conducting layer may consist of at least one electrode. Each electrode may thus individually superpose an electroactive region comprising at least a dielectric polymer, a first conducting layer, optionally a fluid-filled volume as defined above, and an insulating layer. A number of electrodes may be provided in the stimulation member, thereby allowing different possibilities of vibration treatment.

Different structures of the stimulation member are within the scope of the present invention. The stimulation member may have a structure such that the first and second compliant electrically conducting layers at least partly superpose each other. The dielectric polymer may then be comprised in between the two electrically conducting layers. Another example of a stimulation member is a multilayered balloon, wherein the multilayer comprises the insulating layer, the first and second electrically conducting layers and the dielectric polymer layer. The stimulation member may be provided with an inlet, in particular when the stimulation member has a balloon structure. The inlet may for example allow for connection of the stimulation member and/or the layer(s) to other equipment, such as an expansion member to achieve expansion of an expandable stimulation member. More particularly, the stimulation member may comprise an inlet for fluid communication with an enclosed inner volume of the stimulation member, such as an enclosed inner volume of a balloon, lumen or catheter. The enclosed inner volume may be defined by the flexible insulating layer, which first surface forms an outer surface of such a volume.

It should be understood that embodiments and examples described in relation to the first aspect of the present invention are equally relevant, when applicable, to the following second and third aspects of the present invention.

There is, in a second aspect of the present invention, provided a device for vibration stimulation of body tissue in a body cavity, comprising a stimulation member as defined above, wherein the stimulation member is expandable and can be arranged in a first state wherein the stimulation member can be introduced via a body opening into a body cavity, and a second state wherein the stimulation member is expanded to a volume such that the first surface of the electrically insulating layer abuts against the tissue within the body cavity. The stimulation member may thus be expanded such as to establish a good contact surface with the body tissue. Not only does a good contact surface enable efficient stimulation of a selected tissue area, but also smooth delivery of vibration stimulation.

In some embodiments, the stimulation member (of the device) is arranged to vibrate according to a vibration pattern comprising at least one frequency component within the range of 10-500 Hz, such as 50-300 Hz. This implies that the stimulation member may be brought to vibrate at a single frequency, sequentially at several frequencies picked from the above defined ranges, and simultaneously at several frequencies. If the stimulation member is brought to vibrate at one vibration frequency at a time, such a frequency may be within the range of 10-100 Hz, for example within the range of 50-90 Hz, such as within the range of 60-80 Hz, such as around 68 Hz (e.g. 68±5 Hz).

Vibration stimulation at several frequencies simultaneously may be accomplished e.g. by bringing different active regions of the stimulation member to vibrate at different frequencies. Alternatively, vibration stimulation at several frequencies simultaneously may be accomplished by stimulation according to a vibration pattern. Such a vibration pattern may comprise two (or more) different frequency components. In some instances, the vibration pattern comprises both a component of a higher frequency, also referred to as an excitation stimulus, and a component of a lower frequency, also referred to as a main periodic element. In this context, "main periodic element" may refer to an element (or part) of the vibration pattern, which element provides a periodicity of the first frequency to the vibration pattern, whereas "excitation stimulus" may refer to a portion of the vibration pattern providing one or more spatial shifts and/or shifts in abutting pressure of (at least a portion of) the stimulation member from a state of equilibrium.

A vibration pattern may for example comprise a first frequency component within the range of approximately 10-100 Hz, for example within the range of 50-90 Hz, such as within the range of 60-80 Hz, or within 50-70 Hz, such as around 68 Hz (e.g. 68±5 Hz). The second frequency component of the vibration pattern may e.g. be at least 1.5 times as high as the first frequency component. This difference between the two frequencies may allow an improved targeting of different segments of the biological pathway responsible for registering mechanical stimuli such as vibrations.

The vibration pattern may moreover comprise a second frequency component within the range of approximately 90-400 Hz, such as to approximately 110-320 Hz.

Alternatively, the different active regions are brought to vibrate at the same frequency but with a phase shift between each other. In this way the vibrations can be made to travel over the surface of the stimulation member.

In order to bring the stimulation member to its second expanded state, the device may further comprise an expansion member adapted to expand the stimulation member by supplying a fluid to the stimulation member. Fluid, such as gas, is supplied to the stimulation member while it is positioned within the body cavity until a good contact surface and a desired contact pressure, or abutting pressure, is established. The stimulation member may thus define a closed chamber that in its second expanded state holds the supplied fluid and that in its first non-expanded state essentially is void of fluid.

When positioned within a body cavity, the stimulation member may exert a pressure on the body tissue as described above. The device may for example be configured such that the first surface of the insulating layer abuts against the tissue at a pressure of 20-120 mbar. In some embodiments, the abutting pressure corresponds to the fluid pressure within the stimulation member. The abutting pressure or contact pressure of the stimulation member against the tissue may however vary according to the applied vibrations.

Expansion of the stimulation member to a pressure as defined above provides a certain pre-stress on the dielectric polymer layer. This pre-stress may improve the actuator performance of the stimulation member.

It will be appreciated that the abutting pressure may be adapted to the type of body tissue to be stimulated, the type of body cavity and purpose of the treatment. For example, for treatment in the posterior part of the nasal cavity, the pressure may be 70-120 mbar (such as 75-100 mbar).

The stimulation member, preferably comprised in a device according to the second aspect, may be adapted to register a contact pressure between the first surface of the insulating member and the body tissue. For the purpose of pressure registration, the device may further comprise a resistor connected to at least one of the first and second electrically conducting layers; a registering module adapted to register a capacitance between at least a part of the first and the second electrically conducting layers, and a calculating module adapted to calculate a contact pressure between at least a part of the first surface of the insulating layer and the tissue based on the registered capacitance. Changes in the contact pressure, resulting for example from deswelling of tissue, will give a corresponding change in thickness of the dielectric layer and hence a change in capacitance. By registering a capacitance, and changes thereof, of the dielectric layer, a contact pressure may be calculated. The resistor may e.g. be coupled in series with the capacitor formed by the first and second electrically conducting layers and the dielectric material in between these two layers.

The contact pressure between the body tissue and the stimulation member can in some instances be correlated to a subject's health condition. In the nasal cavity of a human subject, for example, the changes in contact pressure over a time period are dependent on the nasal health of the subject. A subject suffering from rhinitis exhibits different contact pressure pattern than do a healthy subject. The contact pressure may thus be used for diagnostic purposes, such as to estimate the progress of the vibration stimulation in the body cavity.

In order to efficiently deliver vibration stimulation to body tissue in a body cavity, adequate positioning of the stimulation member may moreover be required. Adequate positioning of the stimulation member may be accomplished in a number of different ways. For example, the stimulation member may further comprise a guiding element adapted to guide the stimulation member during introduction into a body cavity. The guiding element may for example comprise a length axis in parallel with the opening of the cavity, i.e. body opening, and the body cavity. A body opening should be understood as any natural or surgical opening of the body.

The term "subject" as used herein should be understood as including mammalian subjects, such as human subjects.

The device may further comprise an interface for mechanical and electrical connections in proximity to said stimulation member. The interface is thus located on a part of the device which is situated outside the body cavity when the device is in use. The interface allows connection of the conducting layers with the electric potentials. Furthermore, the interface allows mechanical connections, such as for example connection to an anchoring means, or anchoring member.

According to an embodiment, the body cavity is selected from the nasal cavity or the intestine of the subject, wherein the stimulation member in its second state abuts against the tissue of the nasal cavity or intestine. It is contemplated that various mammalian subjects may benefit from vibration stimulation with a vibration device or method as described herein.

Vibration stimulation may be directed to different parts of the nasal cavity of the human subject. This is e.g. achieved with a stimulation member comprising electroactive regions only at a posterior, or distal, part, or end, of the stimulation member. Alternatively, only electroactive regions at a posterior, or distal, part of the stimulation member are brought to vibrate by application of a time-varying potential. Stimulation may for example be conducted in the posterior part of the nasal cavity for treatment of diseases associated with abnormal activity in the hypothalamus. Non-limiting examples of diseases associated with abnormal activity in the hypothalamus are migraine, Ménière's disease, hypertension, cluster headache, arrhythmia, ALS, irritable bowel syndrome, sleep disorders, diabetes, obesity, multiple sclerosis, tinnitus, breathing disorders, Alzheimer's disease, mood and anxiety disorders and epilepsy. Vibration stimulation in anterior parts of the nasal cavity may on the other hand be useful for treatment of e.g. rhinitis and asthma. In addition, vibration stimulation as described herein may also be conducted in other body cavities of the subject, both air-conducting and liquid-conducting cavities such as blood vessels and gall ducts.

Furthermore, subjects suffering from, e.g. intestinal inflammation, e.g. in the colon, ulcerous colitis, Crohn's disease, and urethritis may benefit from vibration stimulation in the intestine.

There is, in a third aspect, provided a method for treatment by vibration stimulation of body tissue in a body cavity of a human subject, comprising the steps of introducing a stimulation member into a body cavity, said stimulation member comprising a dielectric polymer; and applying a (one or more) time varying potential(s) to said dielectric polymer to impart vibrations to body tissue in the body cavity.

The method as described above thus exploits a stimulation member that may generate mechanical vibrations without an externally arranged vibration generator. It should be understood that the advantages of the method essentially are as disclosed in connection with the first and second aspect of the present invention. It should further be understood that embodiments disclosed in one aspect of the invention may be equally applicable to other aspects of the invention.

The time varying potential(s) may have a frequency content comprising one or more frequency component(s) within the range of 10-500 Hz. The time varying potential thus brings the stimulation member to vibrate according to a vibration pattern that is characterized by the frequency content.

In some embodiments, said introducing further comprises expanding the stimulation member within the body cavity to a state such that the stimulation member abuts the body tissue. Expansion may for example carry on until the stimulation member abuts the tissue at a first pressure. The first pressure may for example correspond to a desired contact pressure, or abutting pressure, between the stimulation member and the body tissue in the body cavity. A desired contact pressure may in turn represent a good contact between the stimulation member and the body tissue that allow efficient delivery of vibrations.

In addition, the step of expanding may further comprise measuring a capacitance of the dielectric polymer of the stimulation member; converting said capacitance to a measured pressure representative of the contact pressure between the stimulation member and the body tissue, and terminating the expansion when the measured pressure has reached the first pressure. The first pressure may for example be within the range of 20-120 mbar.

The expansion of the stimulation member may be accomplished by supplying a fluid to the stimulation member. The stimulation member may thus define a closed chamber that in an expanded state holds the supplied fluid and that in a non-expanded state essentially is void of fluid.

In a further method aspect, there is provided a method for treatment by vibration stimulation of body tissue in a body cavity of a human subject, comprising the steps of introducing a stimulation member into the body cavity, said stimulation member comprising a dielectric polymer layer and a plurality of compliant electrode pairs arranged at opposite surfaces, or at different sides, of the dielectric polymer layer; measuring a capacitance over the plurality of compliant electrode pairs; selecting a subset of compliant electrode pairs for which the measured capacitance is larger than a first capacitance; and applying one or more time varying potential(s) to the subset of compliant electrode pairs. The plurality of electrode pairs may for example be provided as discrete pairs, or may be provided in the form of layers as described in other aspects of the present invention. For instance, one electrode of each pair may form an electrically conducting layer together with corresponding (on the same surface or side of the dielectric polymer) electrodes of the other pairs in the plurality.

The first capacitance is for example an absolute value or represents a desired change in the capacitance. An initial value of the capacitance may for example be registered. When a desired change in the capacitance thereafter is registered, the first capacitance may be considered reached.

A plurality of compliant electrode pairs should in this context be understood as at least two pairs, such as four pairs. In embodiments where the stimulation member comprises an enclosed inner volume the electrode pairs may be distributed along a circumference of the stimulation member.

In this method, the dielectric polymer of the stimulation member is provided with a number of electrodes, preferably arranged in pairs at opposite surfaces or different sides of the dielectric polymer. This allows measuring of capacitance of the dielectric layer once the stimulation member is situated in a body cavity. Parts of the stimulation member may be in contact with the body tissue. The body tissue in contact with the stimulation member exerts a pressure on the corresponding parts of the stimulation member, such that the capacitance of the dielectric layer of each one of those parts is affected. The first capacitance hence represents a contact pressure sufficient for enabling efficient vibration stimulation. The subset of electrodes for which the measured capacitance is larger than the first capacitance is selected for administering vibration stimulation by application of the time varying potential(s).

In another embodiment, the stimulation member is expandable and the step of selecting further comprises expanding the stimulation member to a state such that the capacitance measured over at least one electrode pair surpasses the first capacitance.

In addition, the method may further comprise, after selecting the subset; storing at least a second capacitance measured over at least one electrode pair within the subset. The step of applying may further comprise measuring a capacitance for at least one electrode pair within the subset; calculating a time averaged capacitance for the at least one electrode pair within the subset; comparing the time averaged capacitance with the stored second capacitance, and, if the time averaged capacitance is larger than the second capacitance; decreasing a pressure within said stimulation member by contracting the stimulation member; or if the time averaged capacitance is smaller than the second capacitance; increasing a pressure within said stimulation member by expanding the stimulation member. Dependent on the biological response from the body tissue, the degree of expansion of the stimulation member may be adjusted such as to increase expansion or to decrease expansion, i.e. contract. Heavy deswelling of body tissue may for example occasion lost contact between the stimulation member and the body tissue. In order to once again establish a good contact, the stimulation member may have to be further expanded, e.g. by supply of fluid to the stimulation member. The above mentioned capacitance measurements may advantageously indicate when the expansion/contraction of the stimulation member needs to be adjusted.

Capacitance measurements may moreover be utilized for determining when vibration stimulation can be terminated, i.e. when the human subject's health condition has been positively affected. Therefore, according to one embodiment, the step of applying further comprises measuring capacitance for at least one electrode pair within the subset; calculating a time averaged capacitance for the at least one electrode pair within the subset, and if the time averaged capacitance is smaller than a third capacitance, terminating the treatment in the body cavity. The third capacitance may thus represent a desired health condition in a patient. For example, the third capacitance may indicate when the tissue is deswollen and normalized and when the treatment thus can be terminated.

The third capacitance may, similar to the first capacitance, be either an absolute or relative value.

Further, to ensure that the detected change in capacitance is caused by a change within the body tissue, any leakage from the stimulation member must be minimized.

In one embodiment, the step of introducing comprises introducing the stimulation member into a body cavity selected from the nasal cavity and the intestine.

In one embodiment wherein treatment is conducted in the nasal cavity, the step of selecting may further comprise at least one of: selecting at least one electrode pair positioned at a distal, or posterior, end of the stimulation member, and selecting at least one electrode pair positioned at a proximal, or anterior, end of the stimulation member.

In yet another method aspect, there is provided a method for treatment by vibration stimulation of body tissue in a body cavity of a human subject, comprising the steps of introducing an expandable stimulation member into the body cavity, said expandable stimulation member comprising a dielectric polymer layer and a plurality of compliant electrode pairs arranged at opposite surfaces, or different sides, of the dielectric polymer layer; measuring capacitance over the plurality of compliant electrode pairs; expanding the stimulation member to a state such that a predetermined subset of the measured capacitances exceed a predetermined capacitance, applying one or more time varying potential(s) to the corresponding subset of compliant electrode pairs.

This method enables the establishment of a good contact between at least a part of the stimulation member and tissue within the body cavity. If for example, vibration stimulation is to be delivered only to a part of the body cavity, e.g. the anterior or posterior part of the nasal cavity, expansion may be interrupted when such good contact, as represented by the measured capacitance in comparison with the fourth capacitance, has been accomplished between body tissue and a desired part of the stimulation member, as represented by the predetermined subset. In the appended FIGS. 2*a* and *b*, an example of a device having two subsets of electrodes is shown.

Stimulation members and devices as described herein may be used in the method aspects of the invention.

Further objects and features of the present invention will be apparent from the detailed description and the claims.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

Referring now to the Figures, which are exemplary embodiments, and wherein the like elements are numbered alike.

DETAILED DESCRIPTION OF THE PREFERRED EMBODIMENTS

Figure 1A:
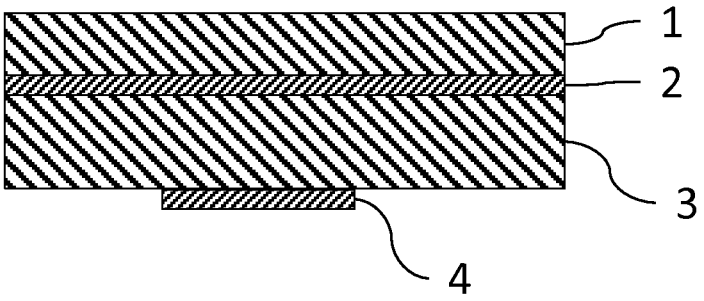
FIG. 1A is a cross-sectional view of a specific example of a stimulation member according to the present invention.

The present invention will now be described with reference to the accompanying drawings, wherein the same or similar elements are identified with the same reference numeral.

FIG. 1A is a cross-sectional view of a specific example of a stimulation member according to the present invention. The stimulation member comprises an electrically insulating layer 1 having a first surface and a second surface, a first electrically conducting layer 2 provided on the second surface of the electrically insulating layer, a dielectric polymer layer 3 provided on the first conducting layer, and a second electrically conducting layer 4 provided on the dielectric polymer layer.

As for example depicted in FIG. 1, the electrically insulating layer, the first electrically conducting layer, the dielectric polymer, and the second electrically conducting layer may form a four layered structure, wherein the first and second electrically conducting layers are provided on opposite surfaces, or different sides, of the dielectric polymer. The dielectric polymer may thus have a first surface, or side, on which the first electrically conducting layer is provided, and a second surface, or side, on which the second electrically conducting layer is provided.

Each of the layers in the multilayered structure may be continuous and provide full coverage of the layer onto which they are provided. Alternatively, the first insulating layer may form a continuous layer on which the first electrically conducting layer, the dielectric polymer layer and the second electrically conducting layer are provided as one or more three-layered patches or portions thus forming active regions of the stimulating member.

Yet another alternative configuration is contemplated wherein the insulating layer, the first electrically conducting layer and the dielectric polymer form a continuous three-layered structure, and wherein the second electrically conducting layer is provided on the above defined second surface of the dielectric polymer as patches or portions thus forming four-layered active region(s) of the stimulation member. Depending on the body tissue to be treated, the patches of portions forming the active region(s) may be distributed differently on second surface of the insulating layer. The number of four-layered active regions may be one, two, three, four, five, six, or more depending on the body tissue targeted for vibration treatment. Further examples of how the different layers may be provided onto each other are accounted for below with reference to the Figures.

When the stimulation member is positioned in the body, the first surface of the insulating layer 1 abuts against the body tissue. Thus, the insulating layer 1 comprises a material such that it does not chemically or biologically affect any body tissue with which it comes into contact. Thus, it may have no local effect on body tissue. Non-limiting examples of materials are plastic materials or rubber materials. In some instances, the stimulation member is made of latex or vinyl.

The first surface of the insulating layer 1 may be adapted to reduce friction between the stimulation member and the surrounding tissue during introduction into and when positioned in the nasal cavity. The insulating layer 1 may e.g. be constructed from a material providing a smooth first surface or be coated with a lubricant, such as e.g. a paraffin solution.

The second surface of the insulating layer 1 may be adapted to allow for a first electrically conducting layer 2 to be arranged on the second surface such that good adhesion, electrical conductivity, and durability is achieved.

Furthermore, the electrically insulating layer 1 is flexible, i.e. compliant and capable of being repeatedly bent and flexed. This for example enables the stimulation member to be inserted into and removed from a body cavity.

On the second surface of the electrically insulating layer 1 there is provided a first compliant electrically conducting layer 2. This layer may in one embodiment be a continuous layer covering essentially the entire available second surface of the electrically insulating layer positioned within the body.

The first electrically conducting layer 2 can furthermore be electrically connected to a ground potential to protect the patient in case there is a malfunction of the device such as a rupture of the outermost insulating layer. If there is an electrical break down of the dielectric layer 3, any current is immediately connected to ground. The first electrically conducting layer 1 may be applied by e.g. electroless plating, ion implantation, physical vapour deposition, sputtering, spray deposition, or other methods known in the art and may comprise a material that is chemically compatible with the dielectric polymer material.

In one embodiment, the dielectric polymer layer 3 is provided on the first conducting layer 2 and may wholly or partly cover the first conducting layer 2. An example of a partly covering dielectric polymer layer 3 is a layer formed into patches or portions which can be individually controlled and thereby enable local and/or selective stimulation of body tissue. Non-limiting examples of dielectric polymers are polyurethane, silicone, fluorosilicone, ethylene propylene, polybutadiene, and isoprene. The dielectric polymer may have elastic properties.

The thickness of the dielectric polymer layer 3 is selected such as to enable an optimization of the actuation while not compromising with durability or ease of manufacture. A thinner layer gives a higher electric field for a given voltage and thus a lower voltage can be used. A thinner layer also gives a lower capacitance and a correspondingly shorter time constant, which may provide a fast and well controlled mechanical response to electrical actuation. On the other hand, a thinner layer might be more susceptible to electrical break through. A non-limiting example of layer thickness is 50 μm.

Furthermore, a hardener might be added to the dielectric polymer layer 3 to increase the elasticity (Young's modulus) of the material. This may also increase the electrical breakdown field strength and the electrical permittivity of the material.

On at least a part of the dielectric polymer layer there is provided a second compliant electrically conducting layer 4 that can be electrically connected to a second electrical potential. The second conducting layer 4 is e.g. patterned, or formed into one or more channel(s) comprising one or more electrode(s) having the form of a patch-like structure, and an electrically conducting trace, or pathway, connecting the patches to each other and/or to an external voltage source. Each electrode can be individually energized to provide for selective administration of vibrations. Furthermore, the electrodes may be separated from each other by a certain distance to ensure proper electrical insulation.

Alternative embodiments might comprise multiple conducting layers separated by electrically insulating layer, thereby providing more channels.

The first and second electrically conducting layers may comprise a material such as carbon grease, graphite powders, graphite spray, thickened electrolyte, sputtered gold, silver paste, and conductive polymers. The material may be applied by e.g. electroless plating, physical vapour deposition, sputtering, ion implantation, or spray deposition. The patterning may be achieved by e.g. photolithography, using e.g. a photo mask, a photo plotter or laser direct imaging, in combination with etching, lift-off or other techniques known in the art. An alternative may be to use a mask during the deposition process and thus only apply material at its intended location.

In order to achieve a good adhesion, electrical conductivity, and durability of the first and second conducting layers, the elasticity modulus (Young's modulus) may be matched between the conducting layers, the dielectric polymer layer and the insulating layer.

Further, the first and second conducting layers as well as the insulating layer must be sufficiently compliant to ensure that the deformations provided by the dielectric polymer layer are not unduly suppressed.

Figure 1B:
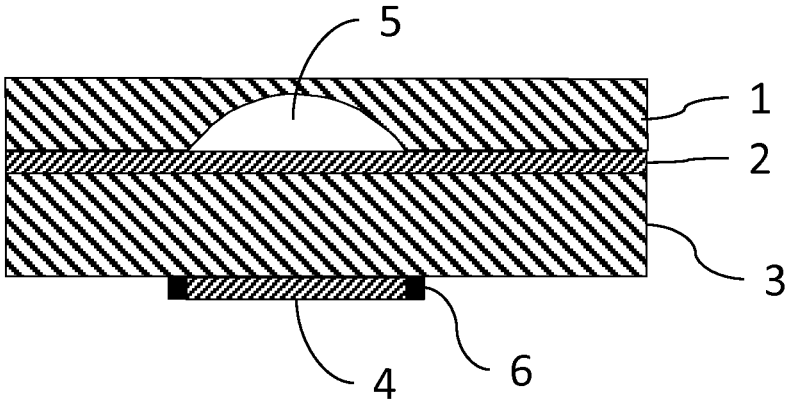
FIG. 1B is a cross-sectional view of a specific example of a stimulation member according to the present invention.

FIG. 1B is a cross-sectional view of a specific example of a stimulation member according to the present invention, wherein the electrically insulating layer 1 and the first conducting layer 2 define an enclosed volume 5 comprising a fluid, such as a silicone oil. There can be provided one or several enclosed volume(s) 5, wherein each enclosed volume 5 individually superpose the electrode(s) 4. As a voltage is applied to the electrode, the area of the dielectric layer 3 under the electrode 4 is increased and the pressure in the enclosed volume 5 reduced. As the voltage then is reduced, the area is decreased and the pressure in the enclosed volume 5 is restored. By alternating the applied voltage, and thereby alternating the pressure in the enclosed volume 5, the stimulation member can be brought to vibrate.

A stiffener may optionally be provided along a periphery of the second electrically conductive layer. As a voltage is applied to the second electrically conductive layer, the surface of the dielectric layer is increased. The stiffener may then suppress expansion in a direction parallel with a surface of the second electrically conductive layer, whereby the surface of the dielectric layer instead is forced to bulge in a direction parallel with a normal to the surface of the dielectric layer. One example of a stiffener is depicted in FIG. 1B, wherein a stiffener 6 is optionally provided along a periphery of the electrode 4, i.e. the second conductive layer 4.

According to an exemplary, non-limiting embodiment, the stimulation member comprises a second electrically conducting layer forming a plurality of individual channels defined by circular electrodes and conducting traces which are electrically connected to the second potential (e.g. a common potential for all electrodes or an individual potential for each electrode). The circular electrode, or patch, may have a diameter of approximately 4 mm and may be provided on an approximately 50 μm thick dielectric polymer layer. The actuation voltage may be 2 kV, which corresponds to an electric field strength of 40 MV/m, in order to avoid electrical breakdown in the dielectric polymer layer. The capacitance for one such patch may be approximately 6.7 pF, with $\in_r=3$. For an applied electrical signal of 500 Hz, the corresponding maximum electrical current can be calculated to 42 μA. Based on this, the required electrical power will be in the range of mW. The minimum distance between the electrodes may be 2 mm, which is required to reduce the risk for electrical breakdown between the electrodes. To further reduce this risk a second insulating layer can be added on the second conductive layer, i.e. the electrodes and the conducting traces.

Figure 2A:
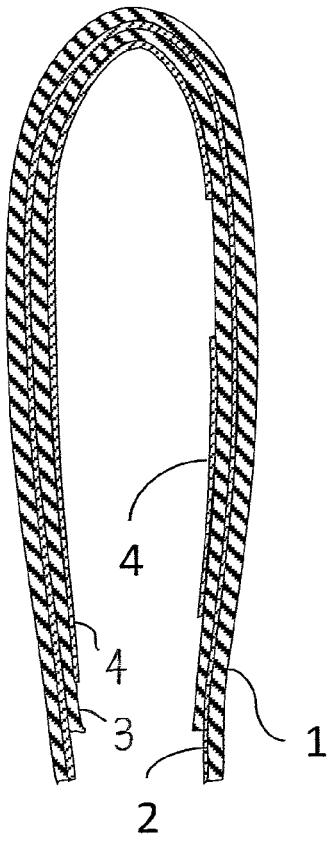
FIGS. 2A and 2B show different vertical cross-sectional views of one non-limiting example of the stimulation member.
Figure 2B:
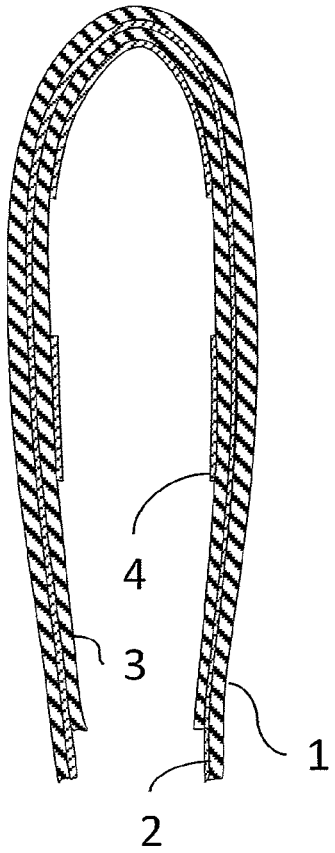

FIGS. 2A and 2B show vertical cross-sectional views of one non-limiting example of the stimulation member. In this example the stimulation member is a multilayered balloon or catheter. The cross-sections show two different positions of the balloon. The first surface of the insulating layer 1 defines an outer surface of the balloon which is adapted to abut against body tissue in a body cavity. The first electrically conductive layer 2 is arranged on the second surface, or the inside of, the insulating layer 1 and covers the entire inner area of the insulating layer 1. The dielectric polymer constitutes a continuous layer 3 covering essentially the entire inner area of the first conductive layer 1. Only a small area (circumference) of the first conductive layer 2 in proximity to the inlet of the balloon is not covered with dielectric polymer. This exposed area is sufficiently large to provide an electrical connection with e.g. a folded flexible circuit board in a connector lumen (not shown). A channel, defined by an electrode (or patch) and a conductive trace (i.e. an electrically conducting pathway), is provided on the dielectric polymer layer 3. In this example the second conducting layer 4 is adapted to impart vibrations to two different parts of the body cavity, e.g. one posterior part and one anterior part with regards to the body opening. The second conducting layer 4 is thus provided onto the dielectric polymer layer 3 in the form of patches or portions thus forming different active regions of the stimulation member. FIG. 2B shows two different patches, while FIG. 2A shows a cross-section of the patches and a conductive trace, positioned at the inlet of the balloon, that is adapted to be electrically connected to the flexible circuit board.

The stimulation member such as a stimulating balloon or catheter may conveniently be produced inside out, starting from the insulating layer with its first surface defining an outside of the balloon, and subsequently adding the first conducting layer, the dielectric layer, the second conducting layer and a possible stiffener to the outside of the balloon. As the layers are completed, the balloon is again turned inside out, providing a stimulation member as shown in e.g. FIGS. 2A and 2B.

It is realized that the stimulation member is not limited to the shape of a balloon. Other shapes, such as cylinders, are also feasible.

Figure 3A:
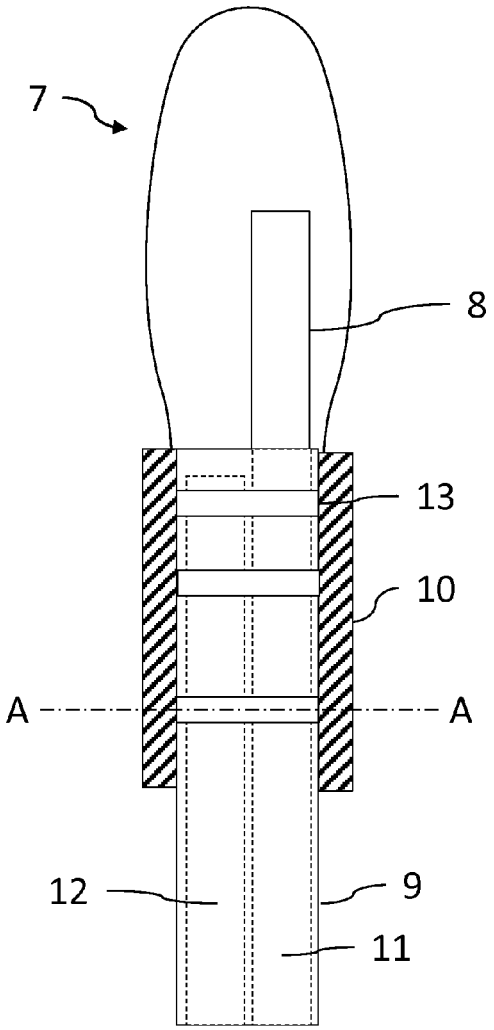
FIG. 3A is a partial cross-sectional view of a specific example of a device according to the present invention.
Figure 3B:
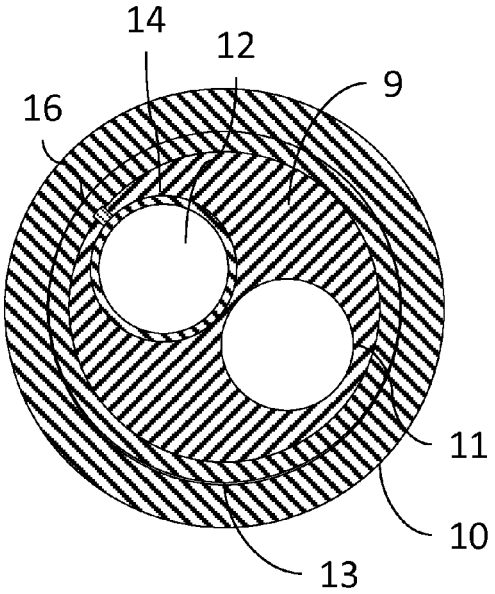
FIG. 3B is an enlarged horizontal cross-section at line A-A of FIG. 3A.

With reference to FIGS. 3A and 3B, a specific example of a device according to the invention will now be discussed.

FIG. 3A is a partial cross-section of the device, showing a cross-section of an expandable stimulation member 7 and a sleeve 10, and a side view of a guide pin 8, a tube 9, and a tube electrode 13. An expansion lumen 11 and a connector lumen 12 are indicated by dotted lines. FIG. 3B is a horizontal cross-section at line A-A in FIG. 3A.

The expandable stimulation member 7, which may for example be a multilayered balloon essentially as depicted in FIG. 2A, abuts and imparts vibrations to tissue of a body cavity when being in an expanded state. The inlet of the stimulation member 7, enclosing an end portion of the tube 9, is connected to the tube 9 by the impacting sleeve 10. Both the expansion lumen 11 and the connector lumen 12 are provided inside the tube 9.

The expansion lumen 11 comprises a channel for supply of fluid to the stimulation member in order to achieve expansion of the stimulation member. The stimulation member 7 thus comprises a chamber for containing fluid supplied by the expansion member 11. The chamber walls are defined by the inner surface layer of the stimulation member 7. The supply of fluid to the stimulation member via the expansion lumen 11 thus influences the volume and degree of expansion of the stimulation member 7. The supply of fluid further accomplishes expansion of the stimulation member 7 by bringing the stimulation member 7 to its expanded state. To allow free passage of fluid from the expansion lumen 11 to the stimulation member 7, the end portion of the expansion lumen 11 comprises at least one opening. The opening is provided within the stimulation member 7. The parts of the expansion lumen 11 and stimulation member 7 in contact with the human body typically define a closed system to prevent leakage of fluid or electrical current to the human body.

The expansion lumen 11 and the connector lumen 12 may for instance be made of a plastic or rubber material.

In one example, an end portion of the expansion member 11 forms a guide pin 8 extending within the stimulation member 7. At least the portion of the expansion member 11 constituting a guide pin 8 is made of a material that is more rigid than the material of the stimulation member in order to facilitate insertion of the stimulation member into the body cavity.

The supply of fluid, e.g. a gas or a liquid, may be controlled by an external apparatus via the expansion lumen 11. Such an external apparatus may comprise an air pump or a cylinder with a movable plunger that, by moving back and forth, can regulate the amount of fluid in the cylinder and thereby regulate the amount of fluid in the stimulation member 7.

The device according to the present invention may conveniently comprise a safety valve, which, in case the fluid pressure within the stimulation member exceeds a certain maximum value, can release some of the pressure, for example by releasing fluid from the stimulation member.

The stimulation member may, when it abuts against body tissue in its expanded state, for instance have a cylindrical, circular, oval or droplet shape, depending on the cavity and anatomy of the patient in question.

The stimulation member may for example have the shape of a balloon with a diameter of 10 mm and an active length of 30 mm. In total there may be 15 channels, wherein each may be individually controlled such that an electrical potential can be selectively applied to one channel, several channels or every channel.

The dimensions of the stimulation member may evidently be adapted to the type, size, and shape of the body cavity of the patient to be treated.

To render possible a smooth and painless introduction into the nasal cavity, the width of the stimulation member may, when arranged in the first state, not exceed the width of the nostril of the patient to be treated. In newborns, for instance, the stimulation member may, in its first state, be approximately 1 mm wide. To further facilitate the introduction of the stimulation member into the nasal cavity it may be pre-formed with a slight bend to better fit the nasal anatomy.

FIG. 3B depicts an example of how an electrical connection between one electrode, i.e. second conductive layer 4, of the stimulation member 7 and one conducting trace 14 of a flexible circuit board may be provided. The flexible circuit board is convolutely arranged inside the connector lumen 12 extending in the tube 9. At the end portion of the tube 9, which is enclosed by the inlet of the stimulation member 7, there is provided a connector plug 16. The connector plug 16 extends radially from the flexible circuit board, through the tube 9, and to an annular tube electrode 13 provided along an outer circumference of the tube 9, and thus connects a conducting 14 trace of the circuit board to the tube electrode 13.

The inlet of the balloon is arranged at the end portion of the tube 9 such that a surface of the second conductive layer 4 of the stimulation member 7 is brought in electrical contact with the tube electrode 13. By using several tube electrodes 14 and conducting plugs 16 a plurality of channels can be connected to the flexible printed circuit board which enables individual control of the channels, thereby facilitating e.g. selective and local vibration stimulation within the body cavity as well as other functionality, such as sensor functions.

A clasping sleeve 10 may be arranged around the inlet of the balloon in order to impart a fastening pressure to the balloon and the tube 9.

To further facilitate insertion and positioning within the body cavity such as the nasal cavity, the device may be provided with a scale to aid the person performing the stimulation. The expansion member may for example be provided with such a scale, which, together with any prior knowledge of the particular patient's anatomy may indicate how far into the nasal cavity the device has been inserted. Alternatively, the device may be provided with a stop bigger than the nostril to prevent the stimulation member from being inserted too far into the nasal cavity. The sleeve 10 can be designed to serve this purpose. Another example of the latter is shown in FIG. 4, wherein the outer diameter of a cover tube can be made larger that the nostril.

In its second state the stimulation member is at least partly expanded to a volume such that at least a part of the first surface of the insulating layer abuts against the body tissue in the body cavity. A contact surface is established between the stimulation member and the tissue of the body cavity, by which a contact pressure and vibration stimulation can be transmitted to the patient. The contact pressure at which the stimulation member abuts against the body tissue may be in the range of 20-120 mbar.

The second electrical potential is adapted to vary as a function of time. Thus the stimulation member is brought to vibrate as the compression of the dielectric material varies with the applied electrical field. The stimulation member is arranged to vibrate according to a vibration pattern typically comprising at least one frequency component within the range of 10-500 Hz, such as 50-300 Hz.

Figure 4:
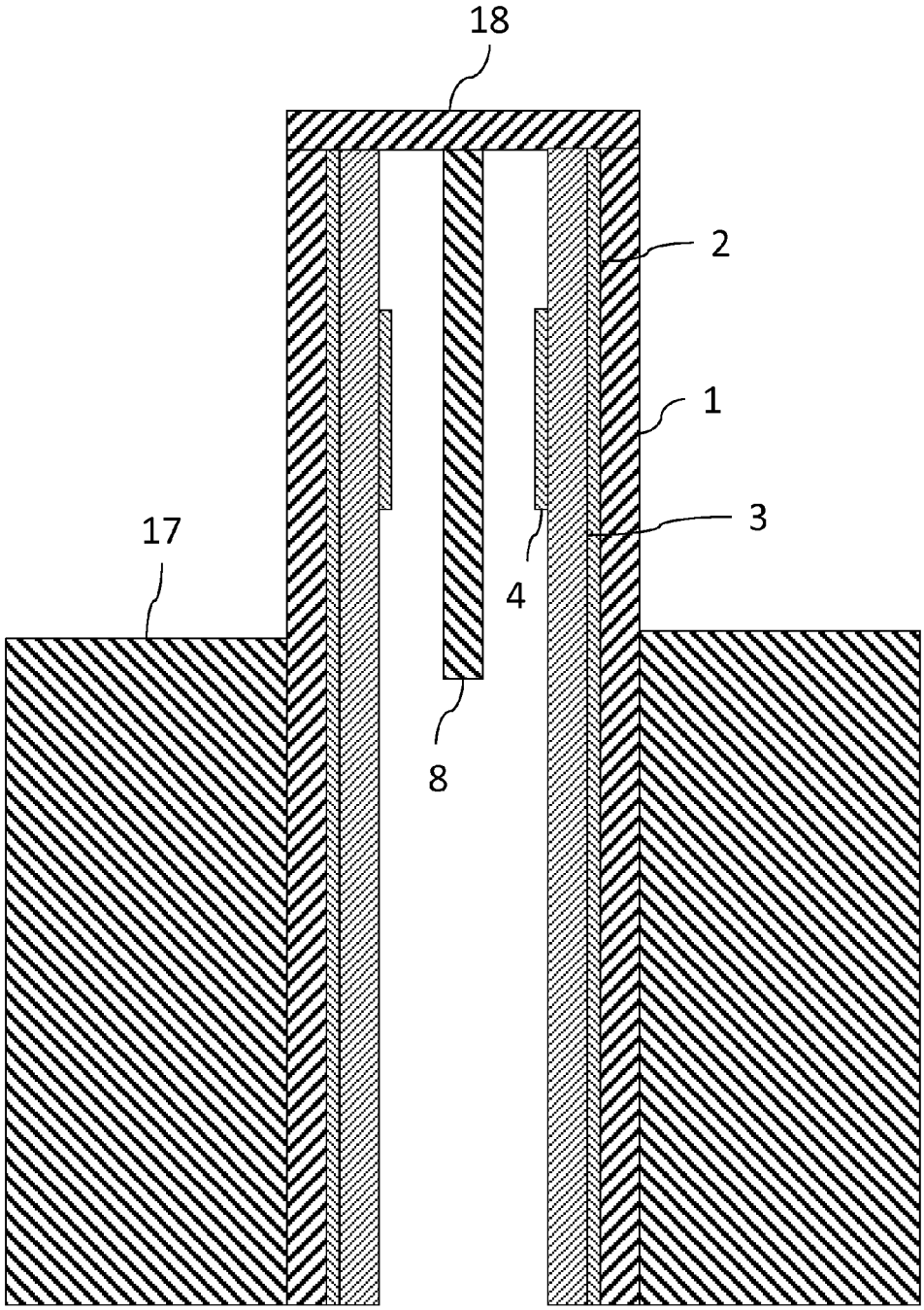
FIG. 4 is a schematical cross-section of a specific example of a device according to the present invention.

FIG. 4 is a schematical cross-section of one non-limiting embodiment of the device. The stimulation member has the shape of a cylinder and comprises an insulating layer 1, a first conducting layer 2, a dielectric polymer layer 3, and a second conductive layer 4. An electrically insulating lid 18 is arranged on the end portion of the cylinder, thereby creating an inner, hermetically sealed volume which can be filled with a fluid. A guide pin 8 is provided in the sealed volume and is attached to the surface of the lid 18 facing the inside of the cylinder. As previously discussed, the guide pin 8 may be made of a material that is more rigid than the stimulation member itself in order to facilitate insertion of the stimulation member into the body cavity.

An end portion of the stimulation member is adapted to be inserted into and to impart vibrations to body tissue in the body cavity. The end portion extends from a cover tube 17, in which the cylinder is inserted and fixated. The cover tube has an inner diameter corresponding to the outer diameter of the stimulation member and an outer diameter sufficiently large to prevent the cover tube 17 from being inserted in the body cavity. Thereby the stimulation member may be prevented from being inserted too far.

At least the end portion of the stimulation member may be formed in a material that allows for deformation in order to facilitate e.g. insertion and positioning. Said end portion of the stimulation member may furthermore be formed in a material that allows for at least partial expansion by e.g. supply of a fluid.

According to one embodiment of the invention, the device comprises a coupling member adapted to connect the stimulation member to an external voltage supply, a ground potential, a pressure generating device such as an air pump, and other equipment for e.g. registering the contact pressure between the stimulation member and the body tissue.

Figure 5:
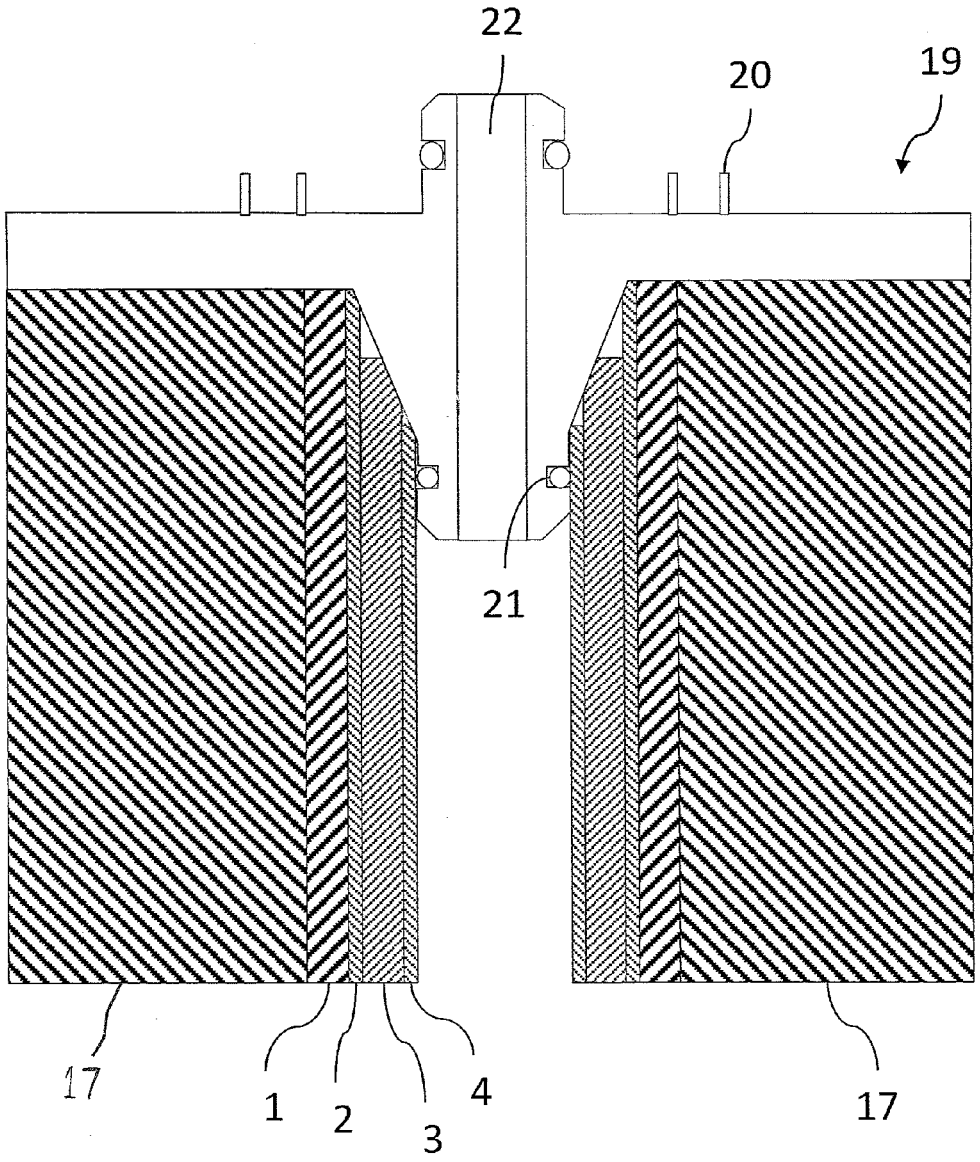
FIG. 5 is a schematical cross-section of a coupling device according to the present invention.

FIG. 5 shows a schematical cross-section of such coupling device 19 comprising connector pins 20, o-ring seal 21, and an air flow channel 22. A stimulation member mounted in a cover tube 17 as shown in FIG. 4 is attached to the coupling member. Exposed regions of the first and second conductive layers 2, 4 abut against contact surfaces of the coupling member, the contact surfaces being electrically connected to the connector pins 20. Thereby electrical contact is established between the connector pins 20 and the first and second conductive layers 2, 4. The o-ring 21 seal seals against the inside of the stimulation member, such that an air pressure can be maintained through the air flow channel 22.

Figure 6:
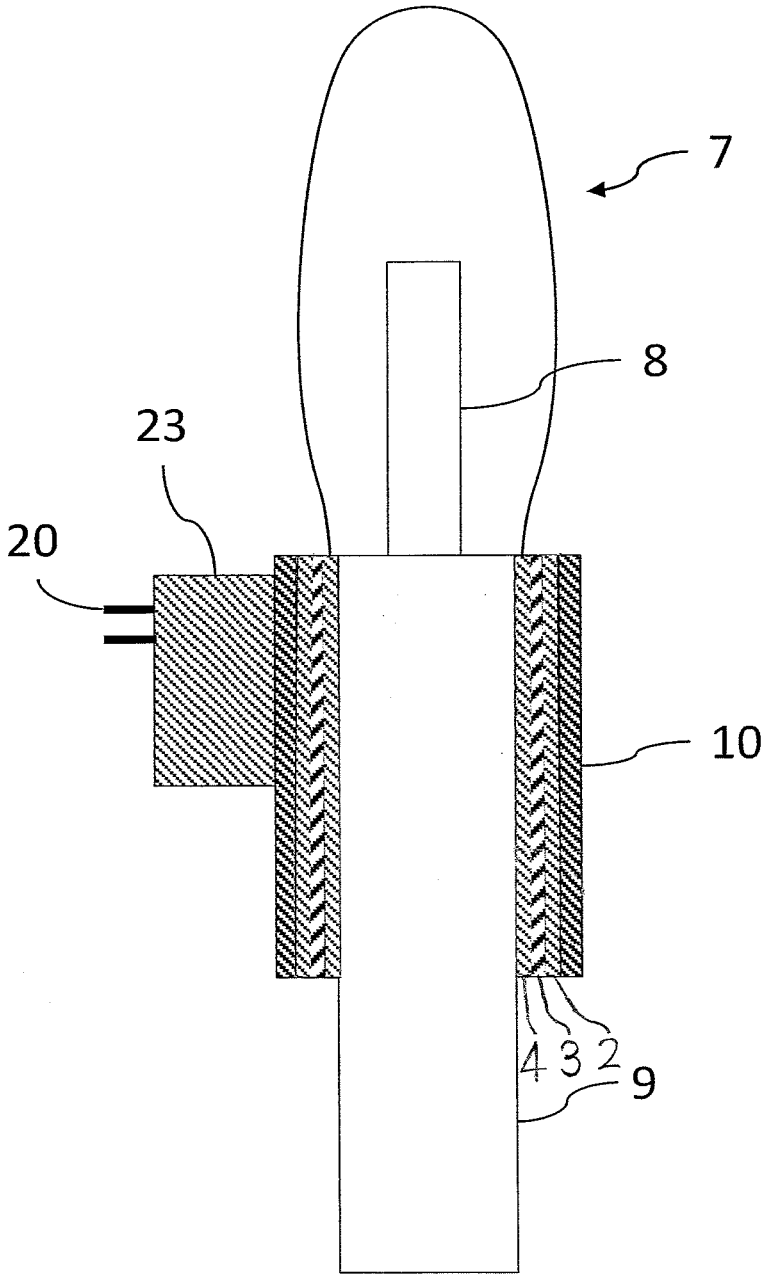
FIG. 6 is a cross-sectional view of a specific example of a stimulation member according to the present invention.

FIG. 6 shows a schematical cross-section of another embodiment of the invention, comprising a stimulation member 7, such as a balloon having an inlet which encloses an end portion of a tube 9, a guide pin 8 extending within the stimulation member 7, and a clasping sleeve 10 arranged around the inlet of the balloon to impart a fastening pressure to the balloon 7 and the tube 9. The clasping sleeve 10 comprises an interface 23 for an anchoring means 23 to prevent the device from unintentionally moving during the stimulation in the nasal cavity, and electrical connector pins 20 for electrically connecting the first and second conducting layers 2, 4 of the stimulation member 7 with the first and second electrical potentials.

In this embodiment at least the dielectric polymer layer 3 and the second conducting layer 4 only cover the inlet of the balloon 7 which encloses the end portion of the tube 9. Thereby the remaining part of the stimulation member 7, which part extends from the tube 9, is a passive part. A passive part or region should be understood as a part of the stimulation member 7 wherein no vibrations are generated. The passive part is instead brought to vibrate by vibrations generated in the part of the stimulation member 7 covering the end portion of the tube 9, and which vibrations are transmitted to the passive part via the fluid enclosed within the tube 9 and the stimulation member 7.

Alternatively, an external actuator may be provided on the outside of the tube, thereby providing a squeezing action. The active section, i.e. actuator, could for instance be divided into plurality of portions axially arranged along a part of the length of the tube. By sequential actuation of these portions, a larger fraction of the displaced volume will travel towards the stimulation member thus providing larger vibration amplitude.

In this embodiment, no electrical connections need to be inserted into the body cavity. There is however no possibility to provide selective vibration stimulation to parts of the body cavity. Instead, the entire stimulation member will vibrate according to essentially the same vibration pattern.

According to one non-limiting example of a vibration device, the dielectric polymer may be used both as an actuator and as a sensor. This gives a possibility to monitor the local contact pressure between the tissue and the stimulation member.

The local contact pressure may be indirectly measured by measuring the capacitance between the first and second conductive layer of a local portion of the stimulation member. Conventionally, the capacitance can be measured by first applying a voltage to the portion of the stimulation member (e.g. a portion defined by the area covered by an electrode of the second conducting layer), removing the voltage source, and then registering the potential difference over a resistor connected to the electrode and the first conductive layer. Finally, by registering the voltage as a function of time, the capacitance may be estimated by a mathematical relation known in the art. Alternatively, a resistor can be connected in series with the electrode and a high frequency voltage can be applied to this circuit. The resulting voltage over the resistor is subsequently measured. This is in effect a high-pass filter. Thus, by selecting a suitable value for the resistor the capacitance can be measured when vibrations are applied.

An additional conducting trace not connected to any electrode may be provided in parallel with the ones actually used. The capacitance measured between this trace and earth is then subtracted from the one measured between the electrode and earth. A high frequency low voltage signal is preferably used to ensure that the capacitive sensing does not interfere with the vibrations.

In the following, the conversion from capacitance to pressure will be described with reference to a local portion of the stimulation member comprising an insulating layer and a dielectric polymer layer that is arranged between a first and a second conductive layer.

The capacitance of the portion is $$C = \varepsilon_0 \varepsilon_r \frac{A}{d}$$

where $\in_0$ is the permittivity of free space, $\in_r$ is the relative permittivity of the dielectric polymer, A is the area of the portion, and d is the thickness of the portion. If a pressure p (i.e. the contact pressure between the portion and the body tissue) is applied, the thickness d will decrease and the area will increase. Assuming the volume of the portion to be preserved gives $$Ad = A'd'$$

where A' and d' are the area and thickness of the portion of the dielectric polymer layer with the contact pressure applied. The capacitance of the compressed portion can be written (the electrodes/first and second conducting layers are assumed to be perfectly compliant)

$$C(p) = \varepsilon_0 \varepsilon_r \frac{A'}{d'}$$

From these three equations it follows that:

$$\frac{C(p)}{C} = \frac{A'}{d'}\frac{d}{A} = \frac{Ad}{d'}\frac{1}{d'}\frac{d}{A} = \left(\frac{d}{d'}\right)^2$$

Assuming that the portion of the dielectric is a linearly elastic material with Young's modulus Y, i.e. the elastic (or tensile) modulus, and that the contact pressure is uniform it follows that $$p = \frac{d - d'}{d} Y = \left(1 - \frac{d'}{d}\right) Y$$

From this it follows that:

$$\frac{d'}{d} = 1 - \frac{p}{Y}$$

and $$\frac{C(p)}{C} = \left(\frac{1}{1 - \frac{p}{Y}}\right)^2$$

Solving for p gives $$p = Y\left(1 - \sqrt{\frac{C}{C(p)}}\right)$$

which can be used to estimate the contact pressure between stimulation member and the body tissue as a function of measured capacitance.

It is evident for the skilled person that features from the described embodiments may be combined in a number of ways. In particular, a design with mechanical and electrical interfaces on the clamping sleeve may be used not only for embodiments with a passive balloon.

Figure 7:
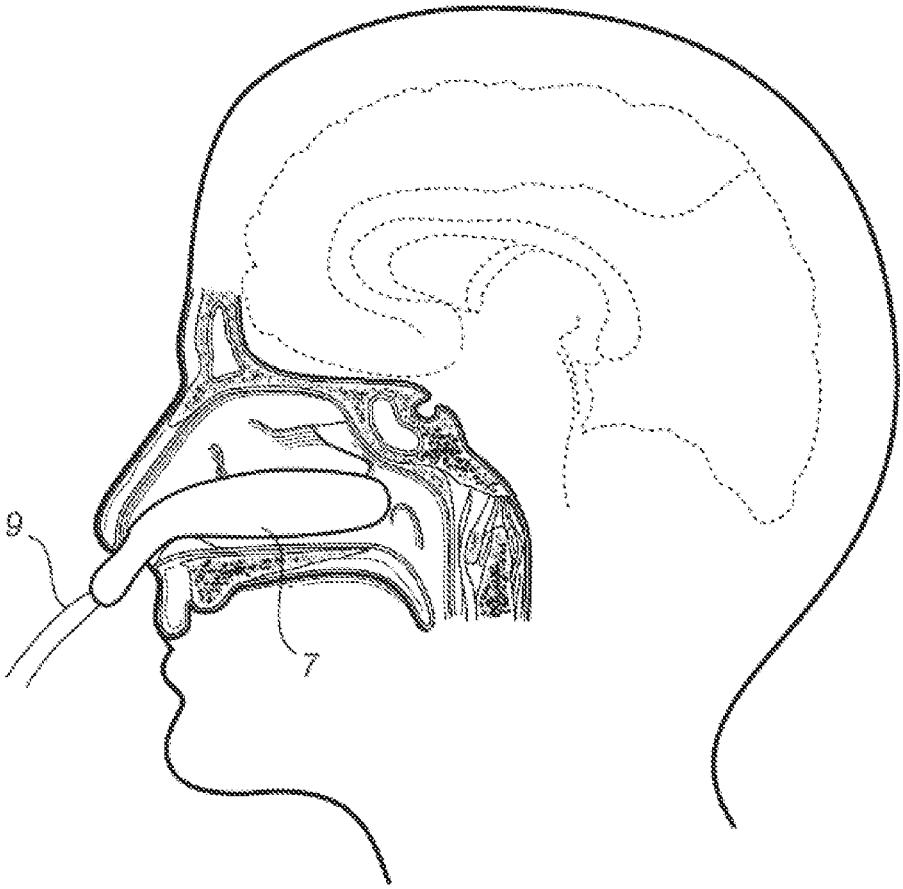
FIG. 7 is a cross-sectional view of one example of a device according to the present invention inserted in the nasal cavity of a human subject.

FIG. 7 shows one embodiment of a method for treatment by vibration stimulation of body tissue in the nasal cavity of a human patient. a stimulation member comprising a dielectric polymer 7 is via the nostril introduced into the nasal cavity. The stimulation member is thus in a first, essentially non-expanded state when introduced in order to facilitate passage through the nostril.

When positioned adequately within the nasal cavity, the stimulation member is expanded to a second state such that the stimulation member is brought into close contact with the tissue of the nasal cavity. It is to be understood that the volume of the stimulation member may be adjusted to the size of the nasal cavity such that a good contact is achieved with the body tissue prior to vibration stimulation. A good and/or close contact refers to such a contact that the available outer surface of the stimulation member in a second, at least partly expanded, state essentially abuts against the surface of the tissue.

To make sure that the stimulation member does not unintentionally move during the stimulation, anchoring means may be provided. These can be in the form of a helmet, a headband, a pair of glasses, a strap, or the like. In some embodiments it is convenient to let the anchoring means mate with a mechanical interface provided on or in proximity to the stimulation member. This interface may further include electrical connections to provide the required potentials.

Subsequently, the stimulation member is brought to stimulate the tissue by vibrations by applying a time varying potential to the dielectric polymer. The time varying potential may have a frequency content comprising one or more frequency component(s) within the range of 10-500 Hz.

While expanding the stimulation member to a volume, or state, wherein the stimulation member abuts against the body tissue, a capacitance of the dielectric polymer may be measured. This capacitance may be converted to a measured pressure representing the contact pressure between the stimulation member and the body tissue. When the measured pressure representing the contact pressure between the stimulation member and the body tissue has reached the desired pressure, expansion may be terminated. The stimulation member is then maintained in an expanded state where it exerts said desired pressure on the body tissue. For example, the desired pressure may be within a range of 20-120 mbar.

Capacitance measurements may also be used for identifying and selecting a subset of compliant electrode pairs, from e.g. a plurality of compliant electrode pairs, to which a time varying potential(s) should be applied. Thus, only a subset of electrodes corresponding to regions of the stimulation member exerting a desired contact pressure against the tissue is brought to vibrate.

When the desired effect on the tissue is achieved, the vibration stimulation is suitably terminated. The at least partly expanded stimulation member is suitably returned to an essentially non-expanded first state before it is removed through the nostril. Contraction of the stimulation member may for instance be achieved by reduction of fluid pressure within the stimulation member by removal of fluid through the expansion member. When the stimulation member is adequately contracted to an at least partly non-expanded state, the stimulation member may be removed from the nose by the patient himself/herself or by assisting personnel.

It is contemplated that tissue stimulation may be performed with at least one stimulation member in at least a first nasal cavity of the human subject. For example, one device according to embodiments of the invention may be used for single stimulation in one nasal cavity only or for sequential stimulation in both nasal cavities. In another example, two devices according to the first aspect may be used for simultaneous vibratory stimulation in both nasal cavities. It should be understood that pressure and vibration frequencies may be the same or different for sequential and/or simultaneous stimulation in both nasal cavities.

While specific embodiments have been described, the skilled person will understand that various modifications and alterations are conceivable within the scope as defined in the appended claims.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for treatment by vibration stimulation of body tissue in a body cavity of a human subject, comprising the steps of:

introducing a stimulation member into the body cavity, said stimulation member comprising a dielectric polymer layer and a plurality of compliant electrode pairs arranged at opposite sides of the dielectric polymer layer;

measuring a capacitance over each of the plurality of compliant electrode pairs;

selecting a subset of compliant electrode pairs out of the plurality of compliant electrode pairs for which the measured capacitance for each of said subset of compliant electrode pairs is larger than a first predetermined capacitance; and applying one or more time varying potential(s) to said selected subset of compliant electrode pairs.

2. The method according to claim 1, wherein the stimulation member is expandable and the step of selecting further comprises expanding the stimulation member to a state such that the capacitance measured over each of said selected subset of compliant electrode pairs surpasses the first predetermined capacitance.

3. The method according to claim 2, further comprising the step of:

after selecting said subset of compliant electrode pairs; storing at least a second capacitance measured over at least one compliant electrode pair within said selected subset of compliant electrode pairs, wherein the step of applying further comprises:

further measuring a capacitance for said at least one compliant electrode pair within said selected subset of compliant electrode pairs during applying one or more time varying potential(s);

calculating a time averaged capacitance for the at least one compliant electrode pair within said selected subset of compliant electrode pairs based on the further measured capacitance for said at least one compliant electrode pair during applying one or more time varying potential(s);

comparing the time averaged capacitance with the stored second capacitance, and if the time averaged capacitance is larger than the stored second capacitance, decreasing a pressure within said stimulation member by contracting the stimulation member, and if the time averaged capacitance is smaller than the stored second capacitance;

increasing a pressure within said stimulation member by expanding the stimulation member.

4. The method according to claim 1, wherein the step of applying further comprises:

measuring a capacitance for at least one compliant electrode pair within said selected subset of compliant electrode pairs during applying one or more time varying potential(s);

calculating a time averaged capacitance for the at least one compliant electrode pair within said selected subset of compliant electrode pairs based on the measured capacitance for said at least one compliant electrode pair during applying the one or more time varying potential(s); and if the time averaged capacitance is smaller than a third predetermined capacitance, terminating the treatment in the body cavity.

5. The method according to claim 1, wherein the step of introducing further comprises introducing the stimulation member into a nasal cavity.

6. The method according to claim 5, wherein the step of selecting further comprises at least one of:

selecting at least one electrode pair positioned at a distal end of the stimulation member;

selecting at least one electrode pair positioned at a proximal end of the stimulation member.

7. The method according to claim 1, wherein the step of introducing comprises introducing the stimulation member into an intestine.

8. A method for treatment by vibration stimulation of body tissue in a body cavity of a human subject, comprising the steps of:

introducing an expandable stimulation member into the body cavity, said expandable stimulation member comprising a dielectric polymer layer and a plurality of compliant electrode pairs arranged at opposite sides of the dielectric polymer layer;

measuring a capacitance over each of the plurality of compliant electrode pairs;

expanding the expandable stimulation member to a state such that each of a predetermined subset of the measured capacitances exceeds a predetermined capacitance, and applying one or more time varying potential(s) to a subset of compliant electrode pairs corresponding to said predetermined subset of the measured capacitances.

* * * * *